US006782106B1

(12) United States Patent
Kong et al.

(10) Patent No.: US 6,782,106 B1
(45) Date of Patent: Aug. 24, 2004

(54) APPARATUS AND METHOD FOR TRANSMITTING SOUND

(75) Inventors: Byung-goo Kong, Seongnam (KR); Sang-ryong Kim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 09/562,890

(22) Filed: May 1, 2000

(30) Foreign Application Priority Data

Nov. 12, 1999 (KR) ..... 1999-50222

(51) Int. Cl.[7] ..... H04R 1/10
(52) U.S. Cl. ..... 381/74; 381/57; 381/110
(58) Field of Search ..... 381/74, 57, 110, 381/104, 107, 123

(56) References Cited

U.S. PATENT DOCUMENTS

| | | | | |
|---|---|---|---|---|
| 4,455,677 A | * | 6/1984 | Fox | 381/110 |
| 4,491,980 A | * | 1/1985 | Ichikawa | 455/344 |
| 4,827,458 A | * | 5/1989 | D'Alayer de Costemore D'Arc | 367/136 |
| 4,941,187 A | * | 7/1990 | Slater | 381/86 |
| 5,551,090 A | | 9/1996 | Thompson | |
| 5,647,011 A | * | 7/1997 | Garvis | 381/123 |
| 5,694,467 A | | 12/1997 | Young, III | |
| 5,785,661 A | | 7/1998 | Shennib | |
| 5,845,197 A | | 12/1998 | Hada et al. | |
| 5,907,538 A | | 5/1999 | White | |
| D410,466 S | | 6/1999 | Mouri | |
| 5,910,997 A | | 6/1999 | Ishige et al. | |
| 5,923,764 A | | 7/1999 | Shennib | |

FOREIGN PATENT DOCUMENTS

| | | |
|---|---|---|
| KR | 94-18598 | 7/1994 |
| KR | 96-24888 | 7/1996 |

* cited by examiner

*Primary Examiner*—Minsun Oh Harvey
*Assistant Examiner*—Brian Pendleton
(74) *Attorney, Agent, or Firm*—Burns, Doane, Swecker & Mathis, L.L.P.

(57) ABSTRACT

An apparatus and method for transmitting sound are provided. The apparatus includes an external sound receiver for receiving external sounds and converting them into an external sound signal, a volume controller for outputting sound signals only if each of the volumes of the sound signal of a sound producing device and the sound signal of the external sound receiver exceeds a predetermined reference level, and a mixer for mixing the sound signal of the sound producing device with the sound signals output from the volume controller and outputting the result. The apparatus mixes ambient sounds having volume exceeding a certain volume with the sound of a sound producing device and transmits the mixed sounds to a pair of headphones which are a sound receiver for a user, thereby allowing the user to hear an ambient alarm sound while the user is listening to the sound of the sound producing device and making it possible for the user to audibly detect danger. Consequently, the apparatus provides user safety.

20 Claims, 3 Drawing Sheets

APPARATUS AND METHOD FOR TRANSMITTING SOUND

The following is based on Korean Patent Application No. 99-50222 filed Nov. 12, 1999, herein incorporated by reference.

BACKGROUND OF THE INVENTION

1. Field of the Invention

The present invention relates to sound processing, and more particularly, to an apparatus and method for transmitting the sound of a sound producing device to a user together with adjusted external sound.

2. Description of the Related Art

Sound receivers or earphones used when a user listens to sound of sound producing devices have been used for a long time. A typical example of these apparatuses is disclosed in U.S. Des. Pat. No. 410,466. These apparatuses have the same technical basis as apparatuses for protecting hearing by blocking ambient sound and apparatuses for aiding a user to hear ambient sound more clearly.

Various methods for protecting hearing from external noise have been proposed. One of them is disclosed in U.S. Pat. No. 5,551,090. Apparatuses and methods related to a hearing aid for aiding a user to hear ambient sound more clearly are disclosed, for example, in U.S. Pat. Nos. 5,923,764, 5,785,661 and 5,910,997.

Recently, people frequently listen to sound of small and portable sound producing devices using sound receivers or earphones while walking or driving. A method for allowing a user to conveniently carry a portable sound producing device with associated earphones is disclosed in U.S. Pat. No. 5,845,197.

These sound receivers and earphones described above are related only to hearing of sound from sound sources. However, apparatuses for bidirectional sound transmission have been developed. U.S. Pat. No. 5,907,538 discloses an apparatus for simultaneously generating audio output and receiving audio input. Bidirectional earphone function can be achieved through this apparatus.

When using these sound receivers and earphones, it frequently happens that users do not hear ambient sound, for example, an alarm whistle which may be a danger signal, a warning voice or a calling sound. In this case, the user him/her self may be in danger or may be placing those around him/her self in danger. One of the methods for solving this problem is an integrated sound/telephone headset system disclosed in U.S. Pat. No. 5,694,467. According to this system, a user can hear audio sound, telephone ringing sound and ambient sound through a microphone in a bypass mode according to the user's selection. When there is an incoming call, the user can convert the bypass mode into an operational mode to answer the phone. At the end of the conversation, the user can go back to the bypass mode through selection. However, this system is limited in usage and does not guarantee that a user will hear a danger signal.

To solve this problem, a method for allowing a user to hear ambient sound by piercing minute holes at the portion of a sound receiver or an earphone contacting the user's ears has been attempted. However, the problem that a user cannot hear ambient sounds well is not overcome when the volume of the sound from a sound producing device is high. Moreover, the sound of a sound producing device comes out of the sound receiver or earphone through the minute holes and may disturb and annoy other people as noise.

SUMMARY OF THE INVENTION

To solve the above problems, it is an object of the present invention to provide an apparatus and method for transmitting the sound of a sound producing device to a user together with adjusted external sound.

Accordingly, to achieve the above object, the present invention provides an apparatus for transmitting a reproduced sound signal of a sound producing device. The apparatus includes an external sound receiver for receiving external sounds and converting them into an external sound signal, a volume controller for outputting only,the reproduced sound signal and the external sound signal having a volume exceeding a predetermined reference level, and a mixer for mixing the reproduced sound signal with the reproduced and external sound signals output from the volume controller and outputting the result.

To achieve the above object, the present invention also provides a method for transmitting a reproduced sound signal of a sound producing device. The method includes the steps of (a) receiving the reproduced sound signal from a sound producing device and an external sound signal corresponding to ambient sounds, (b) transmitting only the reproduced and external sound signals having a volume exceeding a predetermined reference level, and (c) mixing the reproduced sound signal with the sound signal transmitted in the step (b) and outputting the result.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
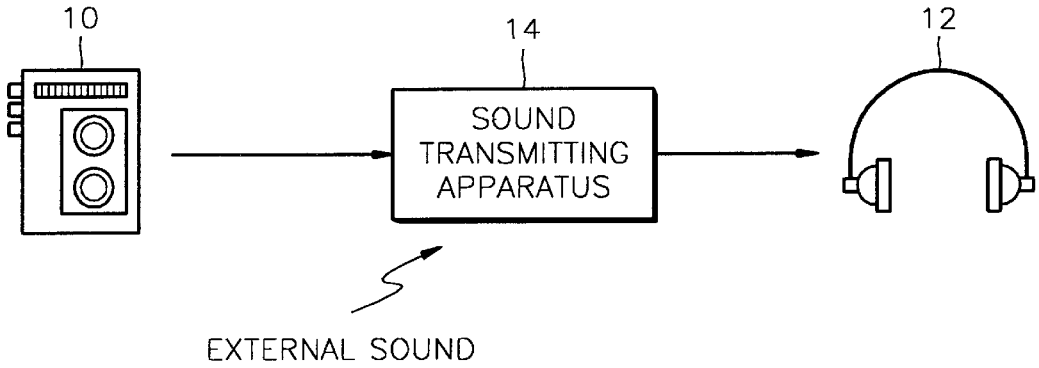
FIG. 1 shows the connection between a sound producing device and a sound receiver through a sound transmitting apparatus according to the present invention.

Referring to FIG. 1, a sound producing device 10 is connected to a sound receiver 12 through a sound transmitting apparatus 14 of the present invention. The sound receiver 12 may be a pair of headphones or a pair of earphones. Typically, the headphones 12 are directly coupled to the headphone terminal of the sound producing device 10. When the sound transmitting apparatus 14 of the present invention is used, a reproduced sound signal output from the sound producing device 10 is input into the sound transmitting apparatus 14. The reproduced sound signal may be directly input into the headphone 12.

The sound transmitting apparatus 14 receives ambient sounds from the outside through a built-in external sound receiver (not shown) in addition to the reproduced sound signal from the sound producing device. The sound transmitting apparatus 14 mixes the external sounds with the reproduced sound signal under predetermined conditions and outputs the mixed sound to the headphones 12. When the external sounds are very weakly or not completely received, only the reproduced sound signal of the sound producing device 10 is transmitted to the headphones 12.

Figure 2:
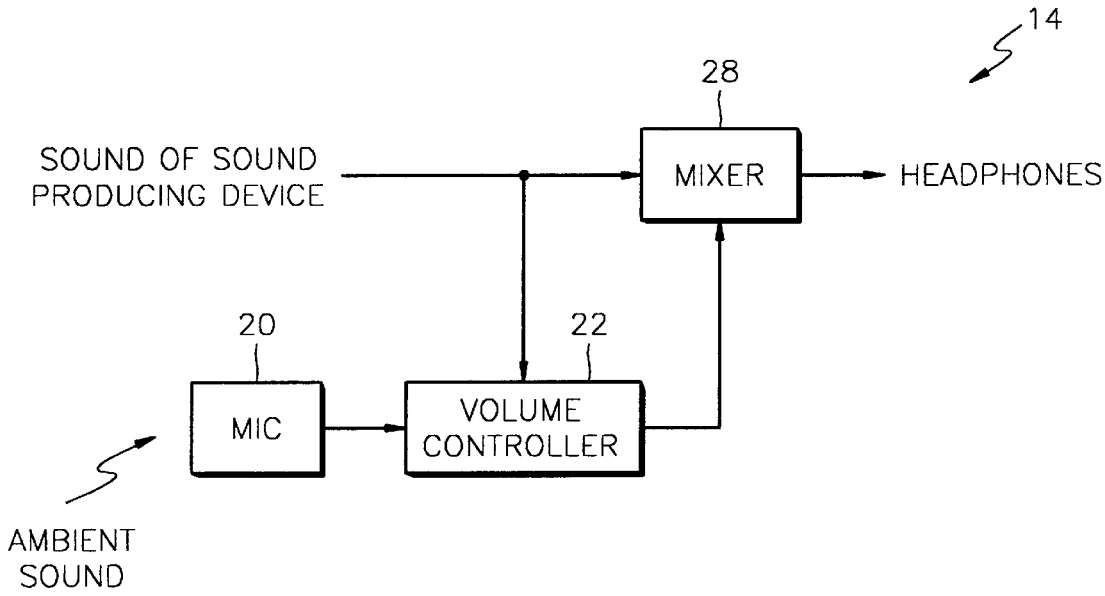
FIG. 2 is a detailed block diagram of a sound transmitting apparatus according to the present invention.

Referring to FIG. 2, an embodiment of the sound transmitting apparatus 14 of the present invention includes an external sound receiver 20 for receiving external sounds and outputting them as an external sound signal, a volume controller 22 for controlling the volume of an input sound when necessary, and a mixer 28 for mixing a reproduced sound signal from the sound producing device with the external sound signal from the volume controller 22 to provide an output.

The external sound receiver 20 may be a microphone (MIC). External sounds other than a sound from the sound producing device are received through the MIC 20. The external sound signal of the MIC 20 and the reproduced sound signal of a sound producing device are input into the volume controller 22. The volume controller 22 outputs only the reproduced and external sound signals having a volume exceeding a predetermined reference level among the external sound signal from the MIC 20 and the reproduced sound signal from the sound producing device. In other words, it is intended that external or reproduced sounds of small volume are not transmitted to a user. A purpose of allowing a user to hear external sounds is to let the user hear ambient sounds, especially, a danger sound, while the user is listening to the sound of the sound producing device. It is assumed that a sound of small volume is not related to a danger signal, and thus the present invention does not transmit a sound having a volume level less than a predetermined reference volume level to a user. Even if the volume controller 22 does not transmit a sound from the sound producing device having a volume level less than the predetermined reference volume level, it does not happen that a user cannot listen to the sound from the sound producing device because the sound from the sound producing device is transmitted to the headphones through the mixer 28.

It is assumed that the predetermined reference volume level may vary according to the place at which the sound producing device is used and the purpose of using the sound producing device. Accordingly, it is preferable that the volume controller 22 includes an external controller 34 of FIG. 3 or 4 for controlling the reference volume level at the outside of a volume controller 22. When the sound transmitting apparatus 14 of the present invention allows a user to change the predetermined reference volume level according to the environment in which the sound producing device is used by adjusting the external controller 34, the user can more conveniently use the sound transmitting apparatus 14 of the present invention.

A user may not want to hear ambient sounds when listening to sound from the sound producing device. For example, a user may want to listen to calm music at a quiet place. For this case, the external controller 34 preferably includes a blocking unit (not shown) for preventing external sounds input through the MIC 20 from being transmitted to the mixer 28.

In other words, a user may use a reference volume level predetermined during manufacturing in the sound transmitting apparatus 14 or change the reference volume level, so that the user can hear only the sound of the sound producing device by increasing the reference volume level very high and blocking transmission of ambient sounds when necessary.

Meanwhile, ambient sounds may not be heard by a user well as the volume of sound output from the sound producing device is increased, even if external sounds having a volume level exceeding a predetermined reference volume level are output to the user. To deal with this case, the volume controller 22 preferably controls the volume of an output sound signal according to the volume of a sound signal from the sound producing device. In other words, the volume of an external sound signal is increased as the volume of a reproduced sound signal from the sound producing device is increased to allow the user to hear the external sounds. A simple example for implementing this function is to control the output volume of a sound signal corresponding to external sounds in proportion to the volume of the sound signal of the sound producing device.

The sound transmitting apparatus 14 preferably includes a maximum volume controller (not shown) for receiving a sound signal from the volume controller 22 having a volume level exceeding a predetermined blocking level and controlling the same to have a volume level corresponding to the predetermined blocking level before the sound signal output from the volume controller 22 is transmitted to the mixer 28, in order to protect the user's hearing when the volume controller 22 of the sound transmitting apparatus 14 controls the volume of external sounds. The maximum volume controller is preferably realized as an automatic gain control (AGC) device.

Figure 3:
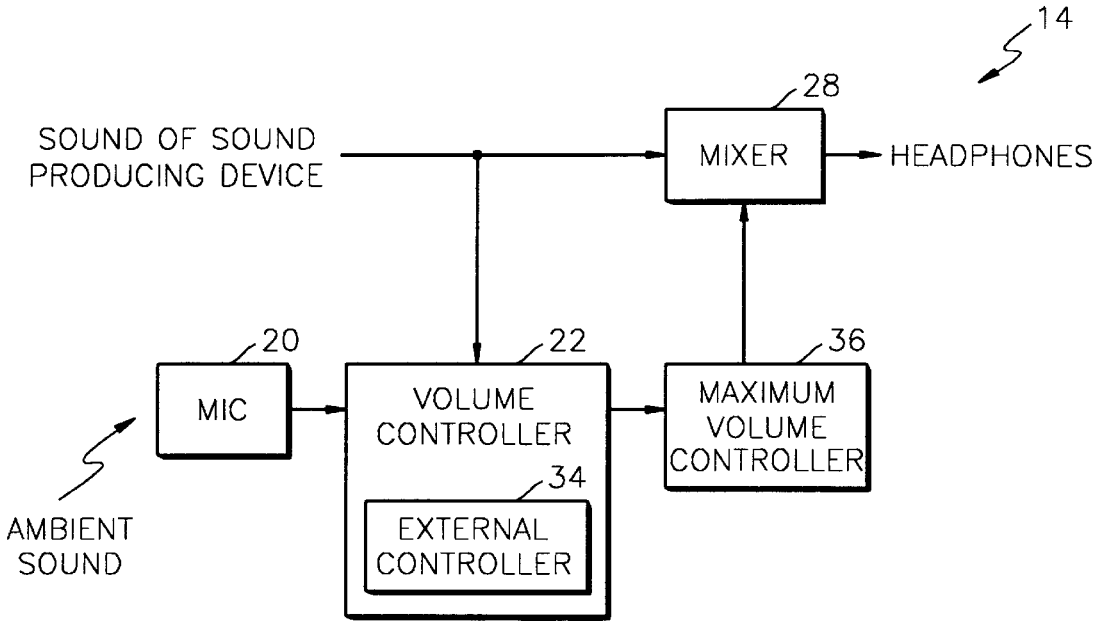
FIG. 3 is a block diagram of a sound transmitting apparatus in which an external controller and a maximum volume controller are added to the sound transmitting apparatus of FIG. 2 according to the present invention.

FIG. 3 shows a sound transmitting apparatus in which an external controller and a maximum volume controller are added to the sound transmitting apparatus of FIG. 2. A sound signal whose volume is controlled by the volume controller 22 is input into a maximum volume controller 36. The maximum volume controller 36 controls the maximum volume of the sound signal before outputting the sound signal to the mixer 28. The output of the mixer 28 is input into a sound receiver such as a pair of headphones, and thus a user can hear sounds through the sound receiver.

Figure 4:
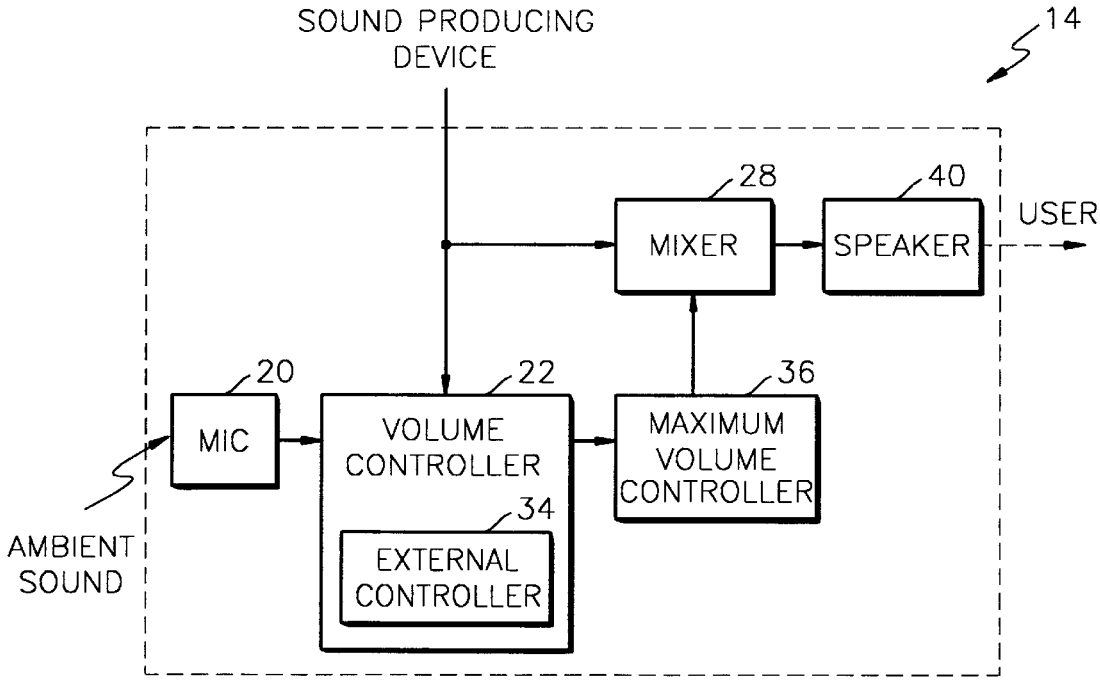
FIG. 4 is a block diagram of a sound transmitting apparatus in which a speaker is added to the sound transmitting apparatus of FIG. 3 according to the present invention.

FIG. 4 shows a sound transmitting apparatus in which a speaker is added to the sound transmitting apparatus of FIG. 3. To directly output the output signal of the mixer 28 to a user, the sound transmitting apparatus of the present invention preferably includes a speaker 40.

In FIG. 4, the sound transmitting apparatus of the present invention is shown in a dashed-line box and corresponds to a combination of the sound receiver 12, i.e., a headphone, and the sound transmitting apparatus 14 of FIG. 1.

An embodiment of a sound transmitting apparatus according to the present invention may be implemented as shown in FIG. 4. In another embodiment, a sound transmitting apparatus of the present invention may be used in a sound producing device, especially, a portable sound producing device. For example, a sound transmitting apparatus of the present invention may be used in a portable cassette player.

In still another embodiment, a sound transmitting apparatus of the present invention may be constructed in a remote controller of a portable sound producing device. The remote controller may be connected to the sound producing device and headphones by a cable or wirelessly. When the remote controller is connected to the sound producing device wirelessly, the mixer 28 of the sound transmitting apparatus of FIGS. 2, 3 or 4 includes an interface for receiving the sound signal of a sound producing device wirelessly. When the remote controller is connected to a headphone wirelessly, the mixer 28 of the sound transmitting apparatus of FIG. 2, 3 or 4 includes an interface for transmitting a sound signal to a headphone wirelessly.

Figure 5:
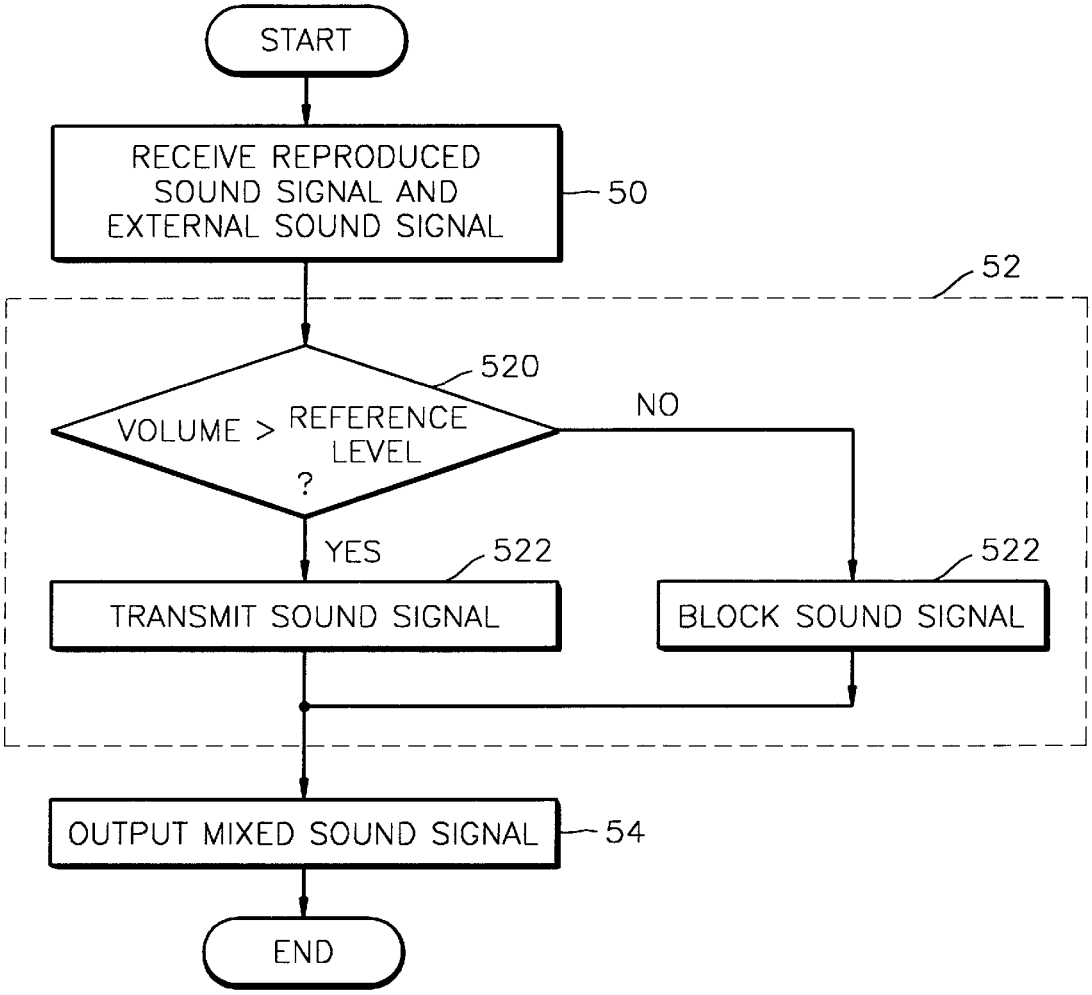
FIG. 5 is a flowchart of a method for transmitting sound according to the present invention.

FIG. 5 is a flowchart of a method for transmitting sound according to the present invention. The method includes a step 50 of receiving a reproduced sound signal from a sound producing device and an external sound signal corresponding to ambient sounds, a step 52 of transmitting only the reproduced sound signal and the external sound signal having a volume exceeding a predetermined reference level, and a step 54 of mixing the reproduced sound signal with the transmitted sound signal to provide an output signal.

The step 52 includes a step 520 of comparing the volume of the reproduced sound signal and the volume of the external sound signal with the predetermined reference level and a step 522 of transmitting only the reproduced and external sound signals having a volume exceeding the predetermined reference level and blocking the remaining sound signals.

The predetermined reference level of the step 52 or 520 is preferably controllable because it is desirable to change a reference of outputting ambient sounds according to an ambient environment or noise in the ambient environment.

It is preferable that the volume of the transmitted sound signal is controlled according to the volume of the reproduced sound signal of the sound producing device when the volume of the transmitted sound signal exceeds the predetermined reference level in the step 522.

It is preferable that the method also includes the step of controlling the volume of the transmitted sound signal to be a volume corresponding to a predetermined blocking level when the volume of the sound signal generated in the step 522 of the step 52 exceeds the predetermined blocking level.

The predetermined blocking level is preferably controllable because it may be necessary to protect the user's hearing by limiting the volume of overly loud ambient sounds and it may be also necessary to control the predetermined blocking level limiting the volume of the ambient sounds according to an ambient environment or ambient noise.

The method according to the present invention is stated in the description of the operation of a sound transmitting apparatus according to the present invention, and thus the more description thereof will be omitted.

The present invention mixes ambient sounds having volume exceeding a certain volume with the sound of a sound producing device and transmits the mixed sounds to a pair of headphones which are a sound receiver for a user, thereby allowing the user to hear an ambient alarm sound while the user is listening to the sound of the sound producing device and making it possible for the user to audibly detect danger. Consequently, the present invention provides user safety.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An apparatus for transmitting a reproduced sound signal of a sound producing device, the apparatus comprising:

an external sound receiver for receiving external sounds and converting them into an external sound signal;

a volume controller for receiving both the reproduced sound signal and the external signal, and for outputting the reproduced sound signal of the sound producing device only when the reproduced sound signal has a volume exceeding a predetermined reference level, and for outputting the external sound signal of the external sound receiver only when the external sound signal has a volume exceeding a predetermined reference level; and a mixer for mixing the reproduced sound signal and signals output from the volume controller and outputting the result.

2. The apparatus of claim 1, further comprising a maximum volume controller for receiving the sound signals from the volume controller and controlling each of the reproduced sound signal and the external sound signal so that if their volumes exceed a predetermined blocking level, their volumes will be set to the predetermined blocking level, and outputting the controlled sound signal to the mixer.

3. The apparatus of claim 2, wherein the maximum volume controller is an automatic gain control device.

4. The apparatus of claim 1, wherein the volume controller controls the volume of the signal output by the volume controller according to the volume of the reproduced sound signal.

5. The apparatus of claim 1, wherein the volume controller comprises an external controller for allowing a user to control the predetermined reference level from the outside.

6. The apparatus of claim 5, wherein the external controller comprises a blocking unit for preventing the external sound signal from being transmitted to the mixer.

7. The apparatus of claim 1, further comprising a speaker for outputting the output of the mixer to a user.

8. A method for transmitting a reproduced sound signal of a sound producing device, the method comprising the steps of:

(a) receiving the reproduced sound signal from the sound producing device and an external sound signal corresponding to ambient sounds;

(b) transmitting the reproduced sound signal of the sound producing device only when the reproduced sound signal has a volume exceeding a predetermined reference level, and for outputting the external sound signal, only when the external sound signal has a volume exceeding a predetermined reference level; and (c) mixing the reproduced sound signal and signals transmitted in the step (b) and outputting the result.

9. The method of claim 8, wherein the step (b) comprises the steps of:

(b1) comparing the volume of reproduced sound signal and the external sound signal with the predetermined reference level respectively; and (b2) transmitting the reproduced sound signal of the sound producing device and/or the external sound signal, only when the respective signal has a volume exceeding the predetermined reference level and otherwise blocking the same.

10. The method of claim 9, wherein in the step (b2) the volume of the transmitted sound signal is controlled according to the volume of the reproduced sound signal.

11. The method of claim 8, wherein the predetermined reference level in the step (b) can be controlled.

12. The method of claim 8, further comprising the step of controlling the volume of the transmitted sound signals to be a volume corresponding to a predetermined blocking level when the volume of the sound signal transmitted in the step (b) exceeds the predetermined blocking level.

13. The method of claim 12, wherein the predetermined blocking level can be controlled.

14. A system comprising:

a sound producing device produce a reproduced sound signal; and an apparatus comprising:

an external sound receiver for receiving external sounds and converting them into an external sound signal;

a volume controller for receiving both the reproduced sound signal and the external sound signal, and for outputting the reproduced sound signal of the sound producing device only when the reproduced sound signal has a volume exceeding a predetermined reference level, and for outputting the external sound signal of the external sound receiver only when the external sound signal has a volume exceeding a predetermined reference level; and a mixer for mixing the reproduced sound signal and signals output from the volume controller and outputting the result.

15. The system of claim 14, further comprising a maximum volume controller for receiving the sound signals from the volume controller and controlling each of the reproduced sound signal and the external sound signal so that if their volumes exceed a predetermined blocking level, their volumes will be set to the predetermined blocking level, and outputting the controlled sound signal to the mixer.

16. The system of claim 15, wherein the maximum volume controller is an automatic gain control device.

17. The system of claim 14, wherein the volume controller controls the volume of the signal output by the volume controller according to the volume of the reproduced sound signal.

18. The system of claim 14, wherein the volume controller comprises an external controller for allowing a user to control the predetermined reference level from the outside.

19. The system of claim 18, wherein the external controller comprises a blocking unit for preventing the external sound signal from being transmitted to the mixer.

20. The system of claim 14, further comprising a speaker for outputting the output of the mixer to a user.

* * * * *